US011202502B1

(12) United States Patent
Berry et al.

(10) Patent No.: US 11,202,502 B1
(45) Date of Patent: Dec. 21, 2021

(54) MIDDLE SHELF INSTALLATION TOOL

(71) Applicants: Christopher H Berry, Trabucco Canyon, CA (US); Dan Ta-Yuan Wu, Diamond Bar, CA (US)

(72) Inventors: Christopher H Berry, Trabucco Canyon, CA (US); Dan Ta-Yuan Wu, Diamond Bar, CA (US)

( * ) Notice: Subject to any disclaimer, the term of this patent is extended or adjusted under 35 U.S.C. 154(b) by 0 days.

(21) Appl. No.: 17/028,802

(22) Filed: Sep. 22, 2020

(51) Int. Cl.
*A47B 57/34* (2006.01)
*A47B 97/00* (2006.01)
*A47B 47/00* (2006.01)

(52) U.S. Cl.
CPC ..... *A47B 57/34* (2013.01); *A47B 47/0083* (2013.01); *A47B 97/00* (2013.01)

(58) Field of Classification Search
CPC ..... A47B 57/34; A47B 47/0083; A47B 97/00
See application file for complete search history.

(56) References Cited

U.S. PATENT DOCUMENTS 1,970,422 A * 8/1934 Foster ..... A47C 19/025 403/300
4,102,276 A * 7/1978 Roveroni ..... A47F 5/116 108/156
5,463,966 A * 11/1995 Nilsson ..... F16B 12/34 108/110
5,553,549 A * 9/1996 Nilsson ..... A47B 9/00 100/144
6,681,705 B2 * 1/2004 Wetterberg ..... A47B 57/40 108/107
7,255,237 B2 * 8/2007 Stitchick ..... A47B 47/022 211/106
8,585,313 B2 * 11/2013 Wojotowicz ..... A47F 5/14 403/293
8,632,272 B2 * 1/2014 Wojtowicz ..... A47B 96/145 403/300
8,672,577 B2 * 3/2014 Wojtowicz ..... A47F 5/14 403/286
8,714,864 B2 * 5/2014 Wojtowicz ..... A47F 5/14 403/286
8,967,401 B2 * 3/2015 Wu ..... A47B 91/024 211/191
9,439,508 B2 * 9/2016 Wojtowicz ..... A47F 5/14
9,474,369 B1 * 10/2016 Tsai ..... A47F 5/10
9,713,378 B1 * 7/2017 Tsai ..... A47B 87/0215
9,723,925 B1 * 8/2017 Tsai ..... A47B 47/00
(Continued)

*Primary Examiner* — Stanton L Krycinski
(74) *Attorney, Agent, or Firm* — Morland C. Fischer

(57) ABSTRACT

A middle shelf installation tool is disclosed for use in combination with a pair of upstanding corner posts during the assembly of a boltless shelving system. Upper and lower sets of hingedly connected corner post surrounding members are spaced one above the other so as to extend across the top and bottom of the installation tool. The installation tool is wrapped in surrounding engagement around the bottom of an upper one of the pair of corner posts and the top of the lower one of the pair. The installation tool forms a splice to hold the upper and lower corner posts in axial alignment one above the other to facilitate the location by a single individual of a middle shelf at the intersection between the corner posts to lie between upper and lower shelves of the system. Once the middle shelf has been installed, the installation tool is pulled off and removed from the corner posts.

9 Claims, 7 Drawing Sheets

(56) References Cited

U.S. PATENT DOCUMENTS

| | | | | |
|---|---|---|---|---|
| 10,302,115 | B2 * | 5/2019 | Bickers | A47B 96/1458 |
| 10,626,905 | B1 * | 4/2020 | Chiu | A47B 57/545 |
| 10,694,849 | B2 * | 6/2020 | Liss | A47B 47/021 |
| 2005/0109723 | A1 * | 5/2005 | Czerwinski | A47B 47/0083 211/183 |
| 2017/0211604 | A1 * | 7/2017 | Tsai | A47B 47/0083 |
| 2017/0280875 | A1 * | 10/2017 | Buckley | A47B 47/021 |
| 2019/0290000 | A1 * | 9/2019 | Davis | A47B 57/34 |
| 2020/0305596 | A1 * | 10/2020 | Min | A47B 96/024 |

* cited by examiner

MIDDLE SHELF INSTALLATION TOOL

BACKGROUND OF THE INVENTION

1. Field of the Invention

This invention relates to a middle shelf installation tool to be removably attached to a pair of upstanding corner posts of a conventional boltless shelving system to create a splice to hold the corner posts one above the other and thereby facilitate the location between the corner posts of a (e.g., middle) shelf from the shelving system by a single individual without requiring the assistance of a second individual. Once the shelf is connected in the shelving system, the installation tool is removed from the pair of corner posts.

2. Background Art

Retail boltless shelving systems are sold through retailers (brick and mortar and online retailers) who typically sell the systems with a two-piece corner post to allow the systems to be packaged in a conveniently sized retail carton. The systems are not typically used by the retailers, but are almost exclusively sold by the retailers to consumers for use in their homes and businesses. For 30 years, nearly all retail packaged shelving systems require that the posts be spliced together by installing middle shelf beams or rails with one rivet of a beam inserted into the top hole of the bottom post and another rivet of the beam inserted into the bottom hole of the top post. This assembly works reasonably well (once installed) but has frustrated consumers because of the difficulty of holding the posts in place one above the other while connecting the beam to the top and bottom posts. It is very difficult for two people to install the beams that splice to a pair of posts and almost impossible for a single person to safely install all of the beams.

What would therefore be advantageous is the availability of an inexpensive, easy to install, and easy to remove tool which may be used by a single individual by allowing him to safely and more easily connect the upper and lower posts one above the other by using the middle shelf beams.

SUMMARY OF THE INVENTION

A middle shelf installation tool is disclosed to be used in combination with a pair of upstanding corner posts during the assembly of a conventional boltless shelving system when a middle shelf is connected between upper and lower shelves of the shelving system. Each corner post has a series of key holes formed therethrough. The installation tool facilitates the connection of the middle shelf to the pair of corner posts at the intersection therebetween by a single individual without requiring the assistance of a second individual to hold the upstanding pair of corner posts one above the other. The installation tool is easily attached to the pair of corner posts to establish a splice by which the top of the lower corner post is coupled to the bottom of the upper corner post. When the middle shelf has been installed, the installation tool is simply pulled off and removed from the shelving system.

The middle shelf installation tool includes a pair of vertical corner post coupling legs that are hingedly joined adjacent one another at one side of the tool. First and second locking tabs project from the top and bottom of a first (i.e., the outermost one) of the pair of corner post coupling legs, and a pair of key holes are formed in the first coupling leg between the locking tabs. A pair of tool positioning bases project from the adjacent second (i.e., inner) one of the pair of corner post coupling legs, and a pair of key holes are formed in the second coupling leg between the positioning bases. Extending horizontally from and hingedly joined to the second one of the pair of vertical corner post coupling legs at the top of the tool is a first upper corner post surrounding arm. A second upper corner post surrounding arm is hingedly joined to the first upper corner post surrounding arm. A first tool pull-off tab projects upwardly from the second upper corner post surrounding arm. An upper locking end flap is hingedly joined to the second upper corner post surrounding arm at the opposite side of the installation tool. A locking slot is formed through the upper locking end flap.

Extending horizontally from and hingedly joined to the second vertical corner post coupling leg at the bottom of the tool is a first lower corner post surrounding arm. A second lower corner post surrounding arm is hingedly joined to the first lower corner post surrounding arm. The first and second upper corner post surrounding arms at the top of the tool are spaced above the first and second lower corner post surrounding arms at the bottom of the tool. A second tool pull-off tab projects downwardly from the second lower corner post surrounding arm. A lower locking end flap is hingedly joined to the second lower corner post surrounding arm at the opposite side of the installation tool. A locking slot is formed through the lower locking end flap.

The middle shelf installation tool is wrapped around the pair of L-shaped corner posts to hold the corner posts one above the other while a middle shelf of the shelving system is connected therebetween. With the bottom of the first vertical corner post coupling leg of the tool lying flush against one side of the lower one of the pair of corner posts such that the locking tab that projects from the bottom of the first corner post coupling leg is located over and against the second key hole from the top of the lower corner post, the second vertical corner post coupling leg, the first and second lower corner post surrounding arms, and the lower locking end flap are all rotated relative to one another at the hinges therebetween so as to completely surround the top of the lower corner post. The lower locking end flap now lays flush against the bottom of the first corner post coupling leg such that the locking tab that projects therefrom is received through the locking slot of the lower locking end flap, whereby the bottom of the installation tool is held in surrounding engagement with the top of the lower corner post, and the top of the tool stands upwardly from and above the lower corner post.

The upper one of the pair of corner posts is held in axial engagement with the lower corner post such that the top of the first vertical corner post coupling leg of the installation tool lies flush against one side of the upper corner post and the locking tab that projects from the top of the first corner post coupling leg is located over and against the second key hole from the bottom of the upper corner post. The second vertical corner post coupling leg, the first and second upper corner post surrounding arms, and the upper locking end flap are all rotated relative to one another at the hinges therebetween so as to completely surround the bottom of the upper corner post. The upper locking end flap now lays flush against the top of the first corner post coupling leg such that the locking tab that projects therefrom is received through the locking slot of the upper locking end flap, whereby the top of the installation tool is held in surrounding engagement with the bottom of the upper corner post. With the pair of corner posts held by the middle shelf installation tool one above the other, shelf supporting rails are coupled to the corner posts at the intersection therebetween so as to provide the support for one corner of the middle shelf of the shelving system. After all of the corners of the middle shelf have been supported by respective pairs of upper and lower corner posts, the installation tools are removed from the shelving system by applying pulling forces to the first and second tool pull-off tabs.

DESCRIPTION OF THE PREFERRED EMBODIMENT

An easy to use tool 1 is disclosed by which to enable a single individual to install a middle shelf between a pair of vertically upstanding upper and lower corner posts of the kind that are found in a retail boltless shelving system having a stack of shelves, where the corners of all of the shelves are supported by pairs of upper and lower corner posts. The present invention provides the advantage of allowing the individual to assemble the boltless shelving system by himself and without requiring the assistance of another individual who would otherwise be required to hold up the pair of corner posts one above the other while the middle shelf is being attached to the posts. Once the middle shelf is installed and the boltless shelving system has been fully assembled, the installation tool 1 is no longer required at which time it may be pulled off and removed from the system.

Details of the installation tool 1 are disclosed while referring initially to FIGS. 1-5 of the drawings. The tool is manufactured from a durable rigid material such as, for example, polypropylene. A pair of adjacent corner post coupling legs 3 and 5 that are located side-by-side one another and run vertically along a first side of the installation tool 1. The coupling legs 3 and 5 are joined to one another by thin integral hinges 7 that are coextensively connected therebetween. The coupling legs 3 and 5 are rotatable relative to one another at the hinges 7 during the detachable connection of the installation tool 1 to a pair of corner posts of the shelving system to which the middle shelf will be connected (best shown in FIGS. 9-13).

Figure 2:
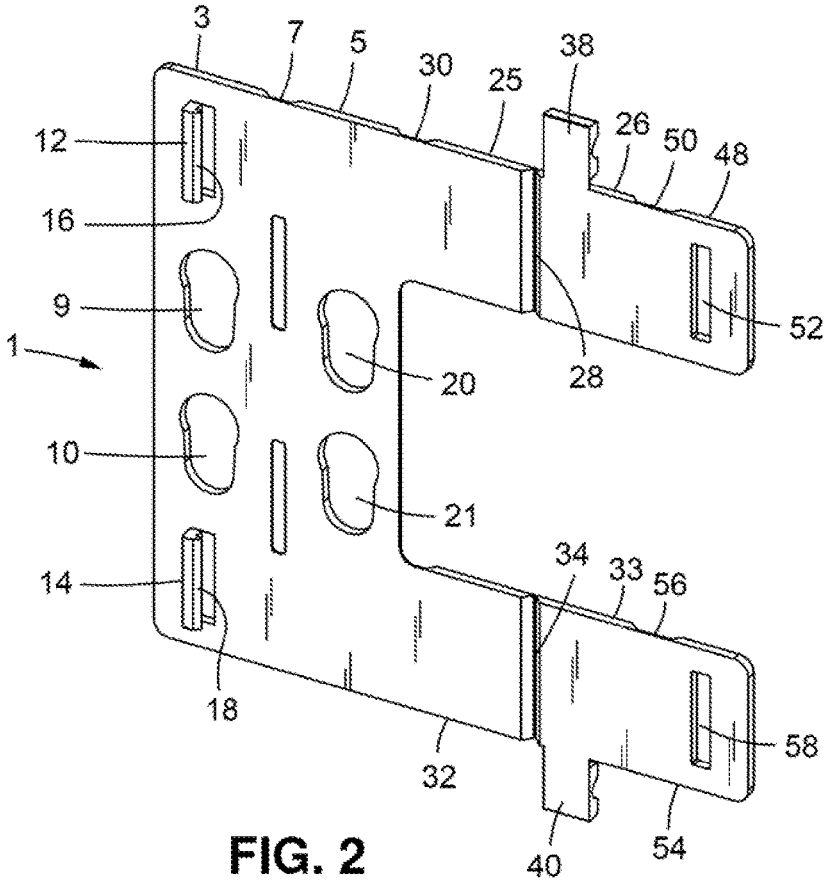
FIG. 2 is a perspective view showing the rear of the middle shelf installation tool of FIG. 1.
Figure 3:
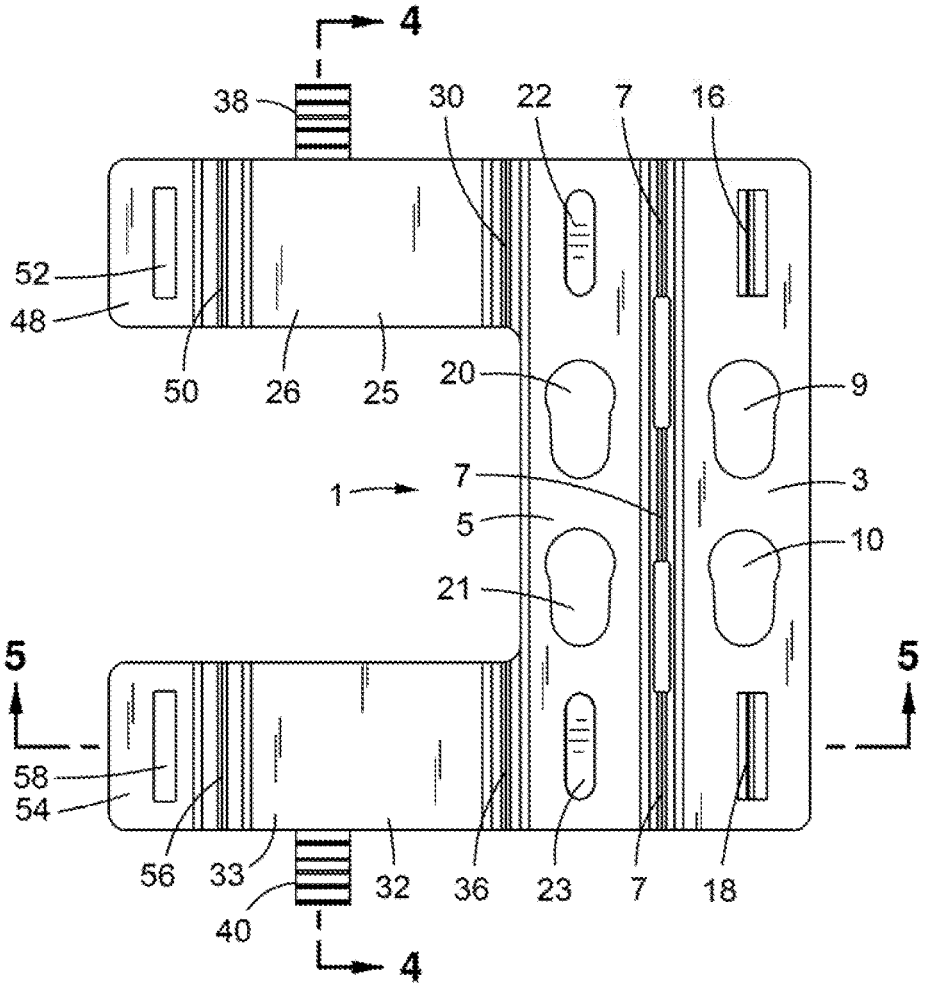
FIG. 3 is a front plan view of the installation tool of FIG. 1.
Figure 4:
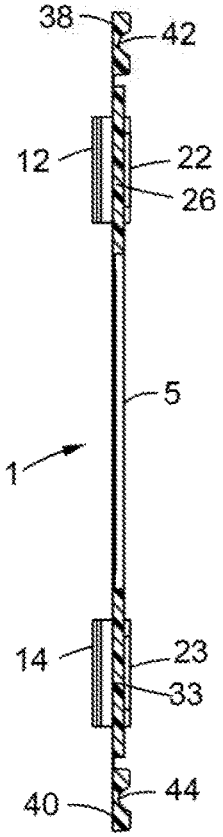
FIG. 4 is a cross-section of the installation tool taken along lines 4-4 of FIG. 3.
Figure 5:
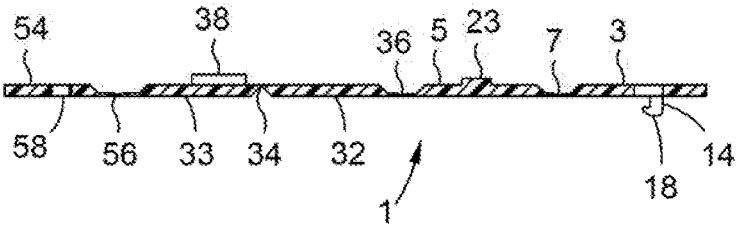
FIG. 5 is a cross-section of the installation tool taken along lines 5-5 of FIG. 3.

A first (i.e., the outermost) one of the pair of adjacent corner post coupling legs 3 that is located at the first side of the installation tool 1 includes upper and lower key holes 9 and 10 formed therein. The key holes 9 and 10 lie one above the other at approximately the middle of the coupling leg 3. Each key hole 9 and 10 through coupling leg 3 ideally has a teardrop shape to match the shape of the key holes that are commonly found in the corner posts of a conventional shelving system. As is best shown in FIG. 2, first and second locking tabs 12 and 14 project outwardly from the rear of the first coupling leg 3. Each of the coupling tabs 12 and 14 terminates in an L-shaped locking tip 16 and 18.

Figure 1:
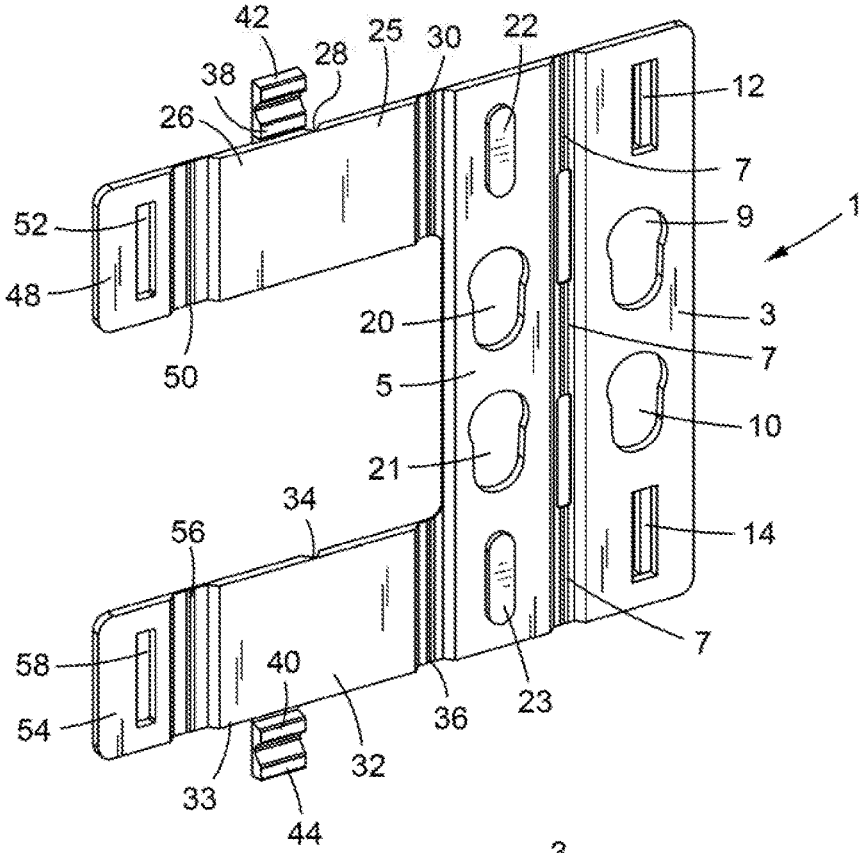
FIG. 1 is a perspective view showing the front of a middle shelf installation tool according to a preferred embodiment of this invention.

The second (i.e., inner) one of the pair of corner post coupling legs 5 that lies adjacent and is hingedly connected to the first coupling leg 3 also includes upper and lower key holes 20 and 21 formed therein. The key holes 20 and 21 of coupling leg 5 are identical to the key holes 9 and 10 of coupling leg 3. As is best shown in FIG. 1, a first coupling base 22 projects outwardly from the front of the second coupling leg 5 above the upper and lower key holes 20 and 21. A second coupling base 23 projects outwardly from the front of the second coupling leg 5 below the key holes 20 and 21. Thus, the first and second tool positioning bases 22 and 23 of the second corner post coupling leg 5 and the first and second locking tabs 12 and 14 of the first corner post coupling leg 3 extend in opposite directions from the installation tool 1.

A pair of upper corner post surrounding arms 25 and 26 are located adjacent one another and extend horizontally across the top of the installation tool 1. The adjacent upper corner post surrounding arms 25 and 26 are joined to one another by a thin integral hinge 28 that is coextensively connected therebetween. The first 25 of the pair of upper corner post surrounding arms 25 and 26 is joined to the top of the second corner post coupling leg 5 by a thin integral hinge 30. Thus, the first upper corner post surrounding arm 25 at the top of the installation tool 1 is adapted to rotate at hinge 30 relative to the top of the second corner post coupling leg 5, and the second upper corner post surrounding arm 26 is adapted to rotate at hinge 28 relative to its adjacent first upper corner post surrounding arm 25.

A pair of lower corner post surrounding arms 32 and 33 are located adjacent one another and extend horizontally across the bottom of the installation tool 1 so as to be spaced below the pair of upper corner post surrounding arms 25 and 26 at the top of the installation tool. The adjacent lower corner post surrounding arms 32 and 33 are joined to one another by a thin integral hinge 34 that is coextensively connected therebetween. The first 32 of the pair of lower corner post surrounding arms 32 and 33 is joined to the bottom of the second corner post coupling leg 5 by a thin integral hinge 36. Thus, the first lower corner post surrounding arm 32 at the bottom of the installation tool 1 is adapted to rotate at hinge 36 relative to the bottom of the second corner post coupling leg 5, and the second lower corner post surrounding arm 33 is adapted to rotate at hinge 34 relative to its adjacent first lower corner post surrounding arm 32.

A first tool pull-off tab 38 is coextensively connected to the upper corner post surrounding arm 26 so as to project upwardly from the top of the installation tool 1. A second tool pull-off tab 40 is coextensively connected to the lower corner post surrounding arm 33 so as to project downwardly from the installation tool 1. Each of the first and second tool positioning tabs 38 and 40 terminates at a respective L-shaping gripping tip 42 and 44 to which a pulling force may be applied as will be described hereinafter.

An upper locking end flap 48 is joined to the second upper corner post surrounding arm 26 at the top and second side of the installation tool 1 by a thin integral hinge 50. A locking slot 52 is formed through the upper locking end flap 48. A lower locking end flap 54 is joined to the second corner post surrounding arm 33 at the bottom and second side of the installation tool 1 by a thin integral hinge 56. A locking slot 58 is formed through the locking end flap 54. The upper and lower locking end flaps 48 and 54 are spaced one above the other at the second side of the installation tool that lies opposite the first side thereof at which the first vertical corner post coupling leg 3 is located. Thus, as is best shown in FIGS. 9-12, the upper and lower locking end flaps 48 and 54 are adapted to rotate at their respective hinges 50 and 56 relative to corner post surrounding arms 26 and 33 to hold the installation tool 1 in surrounding engagement with a pair of corner posts of the conventional boltless shelving system to which this invention has particular application. In this regard, the locking slots 52 and 58 that are formed through the upper and lower locking end flaps 48 and 54 are sized to receive the first and second locking tabs 12 and 14 that project from the first corner post coupling leg 3 when the installation tool 1 is detachably connected in surrounding engagement with the corner posts.

Figure 6:
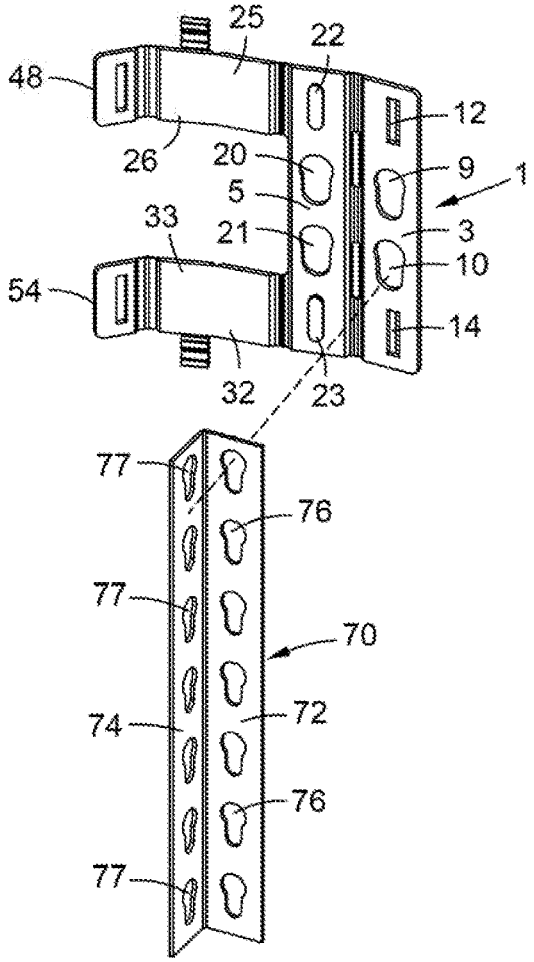
FIGS. 6-8 illustrate the steps of positioning the installation tool against the top of a lower one of a pair of corner posts to which the installation tool is to be attached.
Figure 7:
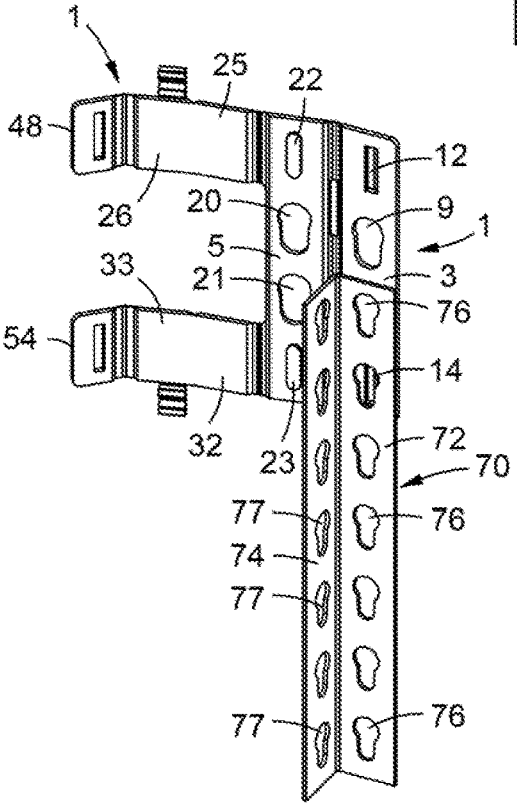
Figure 8:
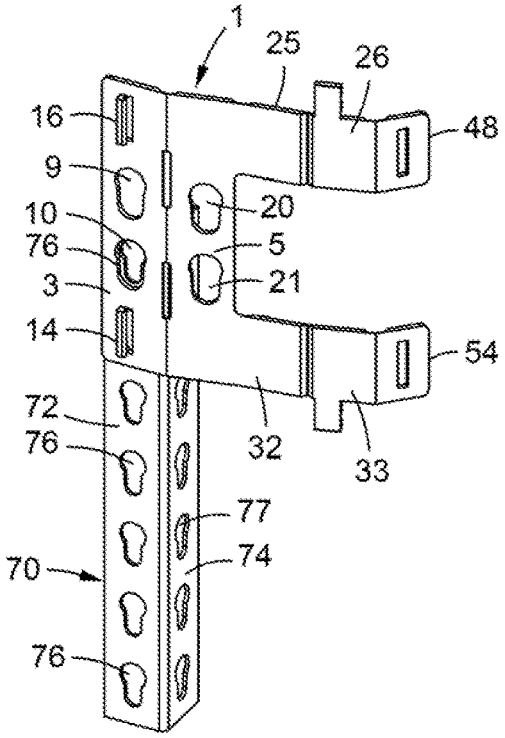
Figure 9:
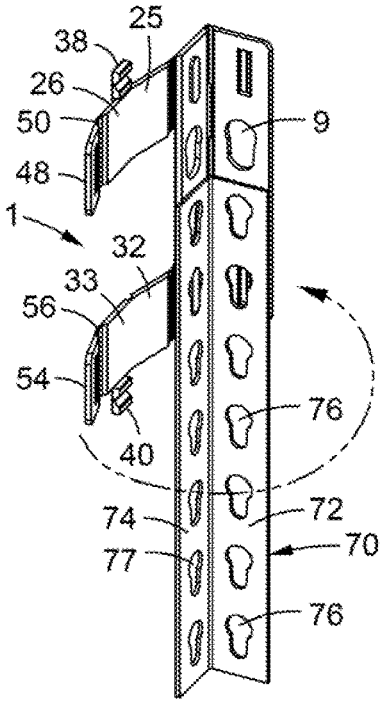
FIGS. 9-13 illustrate the steps of attaching the bottom of the installation tool in surrounding engagement with the top of the lower one of the pair of corner posts.
Figure 10:
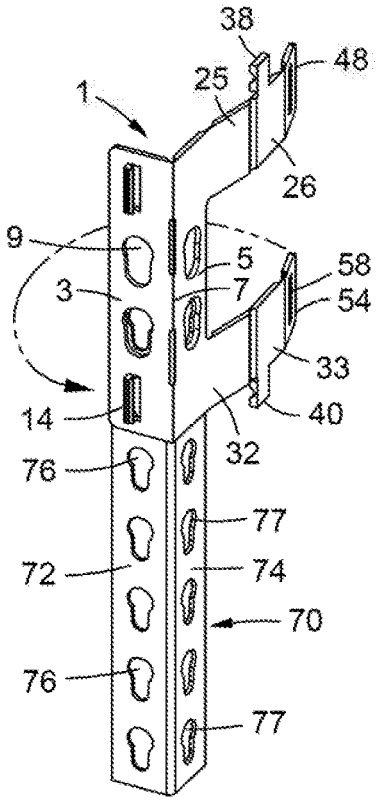
Figure 11:
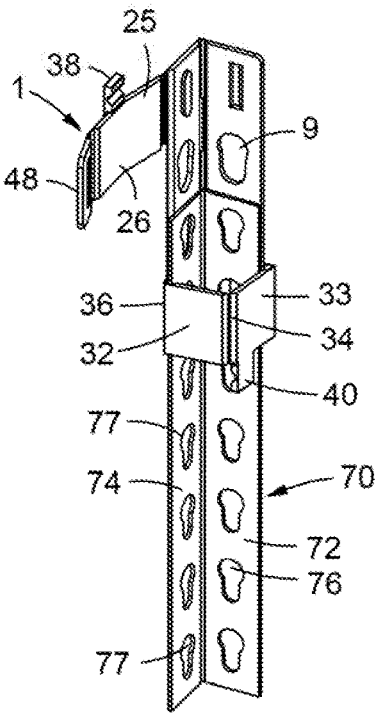

The attachment of the middle shelf installation tool 1 to a pair of upstanding first and second lower and upper corner posts of a conventional boltless shelving system by which to enable one corner of a middle shelf to be connected at the interface between the corner posts by a single individual without the assistance of another is now described while referring to FIGS. 6-17 of the drawings. Turning initially to FIGS. 6-8, the installation tool 1 is shown being attached to a first lower one 70 of the pair of corner posts. The corner post 70 is common to that found in a boltless shelving system (best shown in FIGS. 18-20) that requires assembly prior to use. In this regard, the corner post 70 has an L-shape and first and second sides 72 and 74 that are joined to one another to make a 90 angle. Each of the sides 72 and 74 has a series of teardrop shaped key holes 76 and 77 that match the shape of the key holes that are formed in the corner post coupling legs 3 and 5 of the installation tool 1.

The bottom of the installation tool is attached to the top of the first lower corner post 70 when the lower-most key hole 10 that is formed in the bottom of the first corner post coupling leg 3 of the tool 1 is positioned over and above the first (i.e., the top-most) key hole 76 that is formed in the first side 72 of the corner post. The locking tab 14 that projects from the bottom of the first corner post coupling leg 3 is therefore positioned over and against the second key hole 76 from the top of the first side 72 of the lower corner post 70 (best shown in FIG. 7). Accordingly, the first corner post coupling leg 3 of the installation tool 1 lays flush against the first side 72 of the corner post 70.

FIGS. 9-13 show the second corner post coupling leg 5, the pair of adjacent lower corner post surrounding arms 32 and 33, and the lower locking end flap 54 at the bottom of the installation tool 1 being wrapped around the top of the first lower corner post 70 so that the top of the tool 1 stands above the top of the corner post 70. That is, the second corner post coupling leg 5 is first rotated at the hinge 7 (of FIG. 10) relative to its adjacent first coupling leg 3, such that the coupling legs 3 and 5 are aligned with one another to make a 90' angle against the sides 72 and 74 of corner post 70. Next, the lower corner post surrounding arm 32 is rotated at the hinge 36 (of FIG. 11) relative to the second corner post coupling leg 5. The lower corner post surrounding arm 33 is then rotated at the hinge 34 (also of FIG. 11) relative to its adjacent corner post surrounding arm 32. Lastly, the lower locking end flap 54 is rotated at hinge 56 (of FIG. 9) relative to its adjacent corner post surrounding arm 33.

Figure 12:
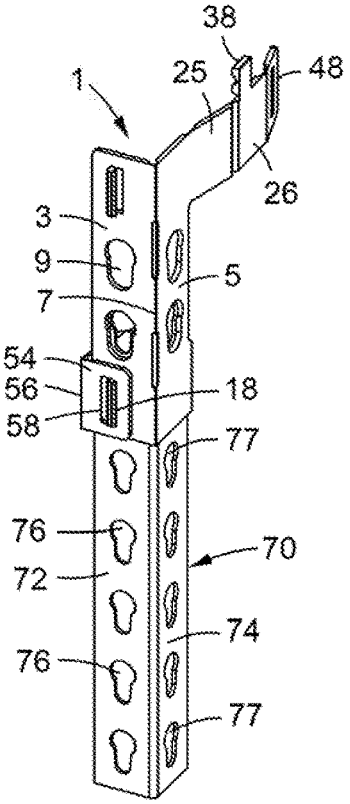
Figure 13:
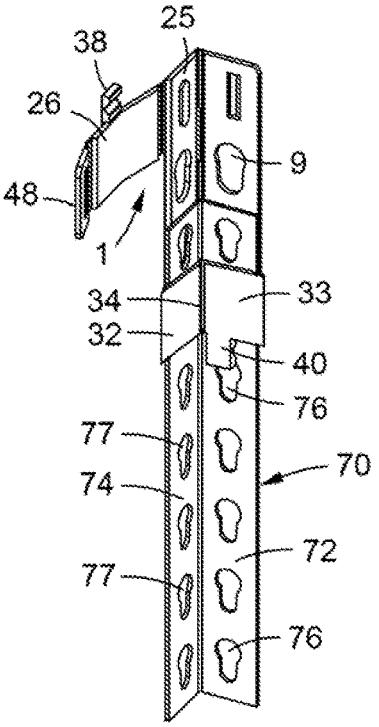
Figure 14:
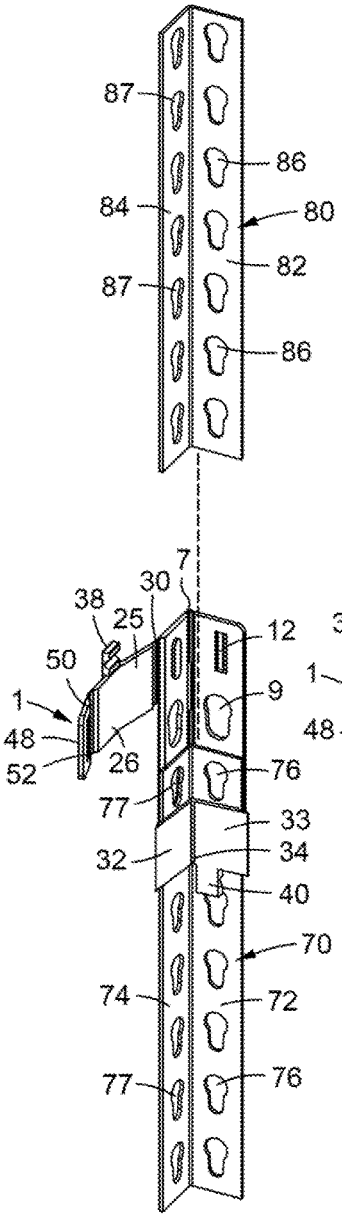
FIGS. 14-17 illustrate the steps of moving an upper one of the pair of corner posts into axial alignment with the lower one of the corner posts and attaching the top of the installation tool in surrounding engagement with the bottom of the upper corner post so that the pair of upper and lower corner posts are held one above the other.
Figure 15:
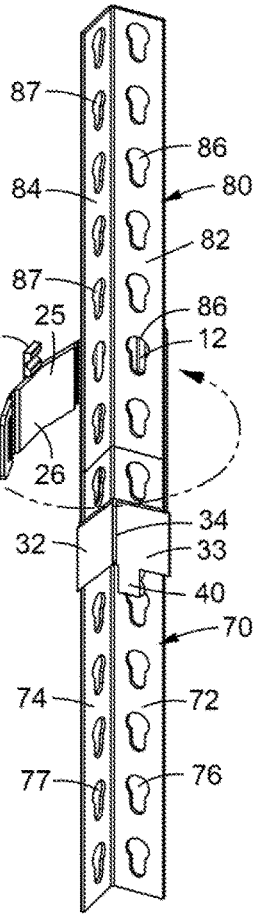

As is best shown in FIG. 12, the lower locking end flap 54 is rotated at hinge 56 to lie flush against the bottom of the first 3 of the pair of corner post coupling legs 3 and 5. The locking tab 14 (of FIG. 10) which projects from the bottom of the first corner post coupling leg 3 is received through the locking slot 58 that is formed in the lower locking end flap 54. The L-shaped locking tip 18 of the locking tab 14 prevents a withdrawal of the locking tab 14 from the locking slot 58, whereby to securely hold the first and second corner post locking legs 3 and 5, the adjacent pair of lower corner post surrounding arms 32 and 33, and the lower locking end flap 54 in removable surrounding engagement with the top of the first corner post 70.

FIGS. 14-17 illustrate the steps by which an upper second one 80 of the pair of corner posts is held by the middle shelf installation tool 1 of this invention in axial alignment with the lower first corner post 70. With an individual using one hand to hold the first and second lower and upper corner posts 70 and 80 end-to-end one another, he uses his second hand to wrap the top of the middle shelf installation tool 1 around the bottom of the upper corner post 80. Like the lower corner post 70, the upper corner post 80 has an L-shape with first and second sides 82 and 84 joined to one another to make a 90 angle. A series of teardrop-shaped key holes 86 and 87 are formed in each of the sides 82 and 84 of the upper corner post 80.

The top of the installation tool 1 is attached to the bottom of the upper corner post 80 in the same manner that the bottom of the tool is attached to the top of the lower corner post 70 as was described while referring previously to FIGS. 6-13. Briefly, therefore, with the upper and lower corner posts 80 and 70 being held end-to-end, the first corner post coupling leg 3 lays flush against the first side 82 of the upper corner post 80, such that the locking tab 12 (of FIG. 14) that projects from the top of the first corner post coupling leg 3 is positioned over and against the second key hole 86 from the bottom of the first side 82 of the upper corner post 80 (best shown in FIG. 15). The second corner post coupling leg 5, the adjacent pair of upper corner post surrounding arms 25 and 26, and the upper locking end flap 48 at the top of the installation tool 1 are all rotated at their hinges 7, 30, 28 and 50 so as to surround the bottom of the upper corner post 80. Accordingly, the corner post coupling legs 3 and 5 lie flush against the sides 82 and 84 of corner post 80, and the upper locking end flap 48 lies flush against the top of the first corner post coupling leg 3. The locking tab 12 which projects from the top of the first corner post coupling leg 3 is now received through the locking slot 52 (of FIG. 14) that is formed in the upper locking end flap 48. The L-shaped locking tip 16 (best shown in FIG. 2) of locking tab 12 prevents a withdrawal of the locking tab 12 from the locking slot 52, whereby to securely hold the first and second corner post locking legs 3 and 5, the adjacent pair of upper corner post surrounding arms 25 and 26, and the upper locking end flap 48 in removable surrounding engagement with the bottom of the upper corner post 80.

Figure 16:
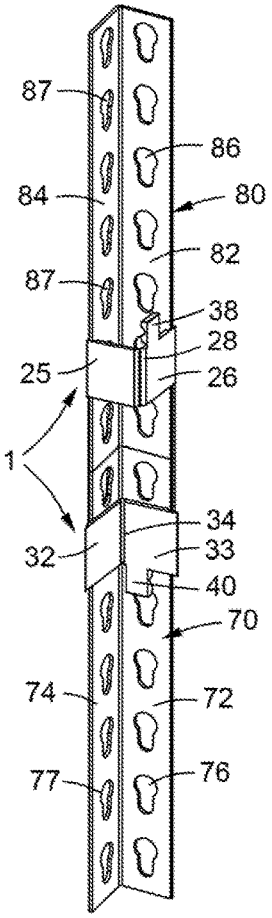
Figure 17:
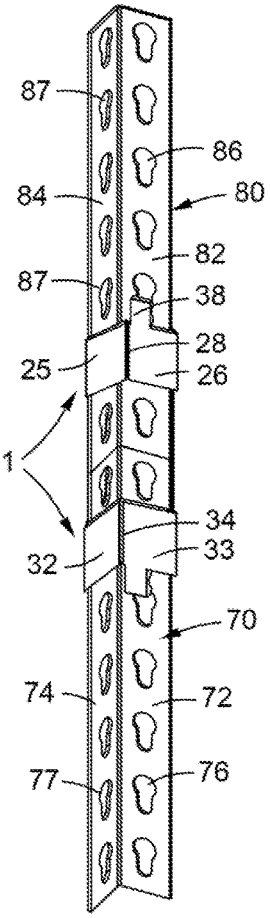
Figure 20:
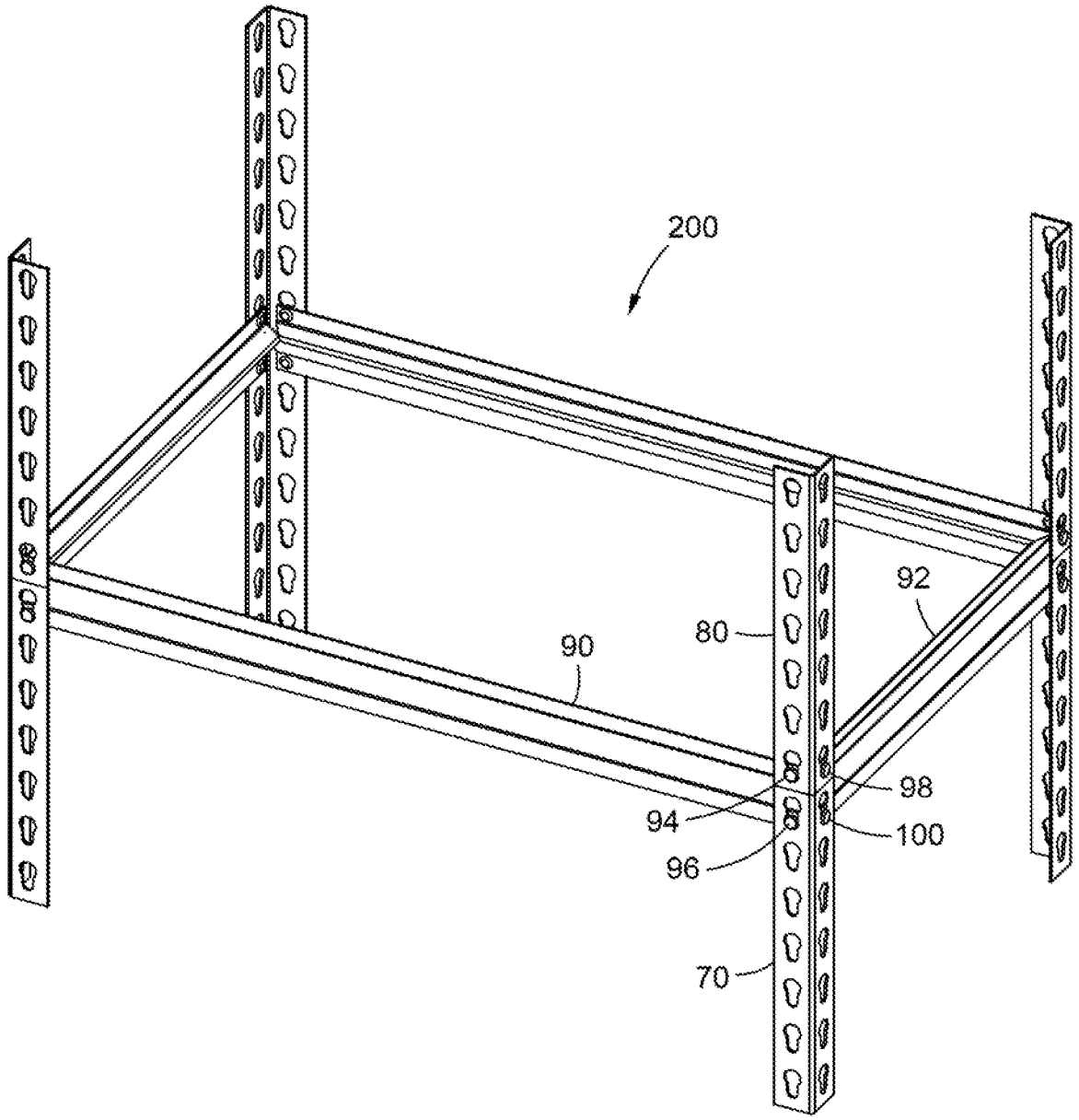
FIG. 20 shows one example of an assembled boltless shelving system having pairs of upper and lower corner posts located at each of the corners thereof and shelf supporting rails extending between the pairs of corner posts with the installation tools removed therefrom.

It may be appreciated that the middle shelf installation tool 1 herein described functions as a splice that extends between and holds the upper and lower corner posts 80 and 70 in their axial alignment one above the other so as to facilitate the installation of the middle shelf. In this regard, with the installation tool 1 wrapped around the top of the lower corner post 70 and the bottom of the upper corner post 80 as shown in FIGS. 16 and 17, the second vertical corner post coupling leg 5 of the tool 1 lays flush against the second sides 74 and 84 of the lower and upper corner posts 70 and 80. Thus, the first and second tool positioning bases (22 and 23 of FIG. 1) which project from the second corner post coupling leg 5 are received through respective ones of the key holes 77 and 87 that are formed in the second sides 74 and 84 of the lower and upper corner posts 70 and 80. The receipt of the tool positioning bases 22 and 23 by the key holes prevents the installation tool 1 from sliding off the corner posts. However, when the assembly of the boltless shelving system is completed (as best shown in FIG. 20), the upper and lower end flaps 48 and 54 at the top and the bottom of the installation tool 1 are pulled off the first and second locking tabs 12 and 14 by means of pulling forces applied to the tool pull-off tabs 38 and 40 to unwrap and remove the installation tool 1 from the corner posts.

Figure 18:
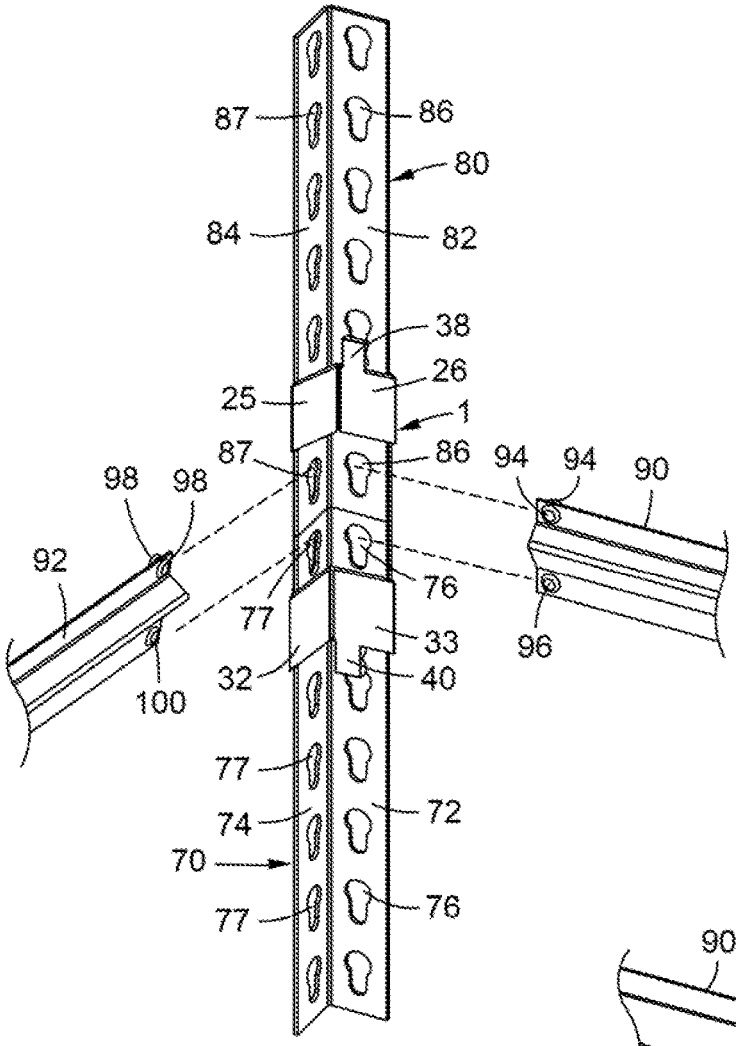
FIGS. 18 and 19 illustrate the steps of attaching shelf supporting rails to the pair of upper and lower corner posts of FIGS. 14-17 at the interface therebetween.
Figure 19:
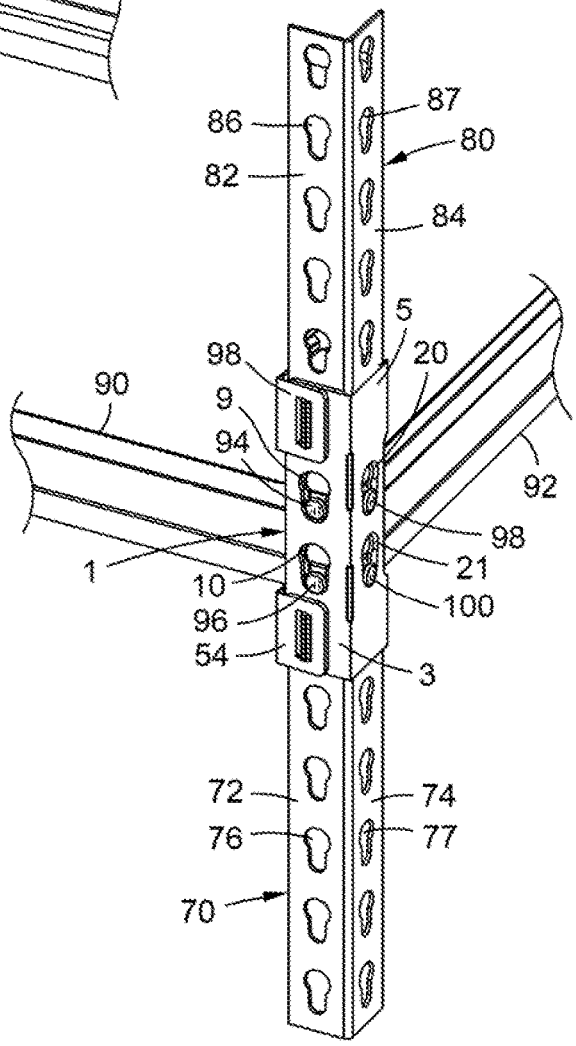

FIGS. 18 and 19 of the drawings show the middle shelf installation tool 1 holding the pair of lower and upper corner posts 70 and 80 in end-to-end axial alignment so that shelf supporting rails (i.e., beams) 90 and 92 can be connected to the corner posts at the intersection therebetween. The first shelf supporting rail 90 carries an upper pair of opposing coupling (e.g., rivet) heads 94 at the top and a first end thereof. The first shelf supporting rail 90 also carries a lower pair of opposing coupling heads 96 at the bottom and the first end thereof. Likewise, the second shelf supporting rail carries an upper pair of opposing coupling heads 98 at the top and a first end thereof. The second shelf supporting rail also carries a lower pair of opposing coupling heads 100 at the bottom and the first end thereof.

The first end of the first shelf supporting rail 90 is connected to the pair of axially aligned corner posts 70 and 80 by first locating one of the upper pair and one of the lower pair of coupling heads 94 and % of rail 90 through the key holes 86 and 76 located at the bottom of the first side 82 of the upper corner post 80 and at the top of the first side 72 of the lower corner post 70. The coupling heads 94 and 96 of the first rail 90 are then pushed through the upper and lower key holes 9 and 10 that are formed in the first corner post coupling leg 3 of the tool 1 which lies flush against the first sides 72 and 82 of the lower and upper corner posts 70 and 80 (best shown in FIG. 19).

The first end of the second shelf supporting rail 92 is connected to the pair of corner posts 70 and 80 by first locating one of the upper pair and one of the lower pair of coupling heads 98 and 100 of rail 92 through the key holes 87 and 77 located at the bottom of the second side 84 of the upper corner post 80 and at the top of the second side 74 of the lower corner post 70. The coupling heads 98 and 100 of the second rail 92 are then pushed through the upper and lower key holes 20 and 21 that are formed in the second corner post coupling leg 5 of the tool 1 which lies flush against the second sides 74 and 84 of the lower and upper corner posts 70 and 80 (also best shown in FIG. 19)

As is best shown in FIG. 20, the procedure just described is repeated for three additional pairs of upper and lower corner posts that are held in axial end-to-end alignment one above the other by respective middle shelf installation tools at each corner of a boltless shelving system 200 so that shelf supporting rails (i.e., beams) like those designated 90 and 92 in FIGS. 18 and 19 can be connected between adjacent pairs of the corner posts. With the shelf supporting rails connected as shown in FIG. 20, a (e.g., middle) shelf may be seated atop the rails between upper and lower shelves (not shown) of the shelving system 200. By virtue of the present invention, the foregoing assembly can be safely completed by a single individual without additional assistance.

The invention claimed is:

1. A combination comprising:

a pair of upper and lower corner posts to which a shelf from a shelving system is to be connected, each of the pair of upper and lower corner posts having a top and a bottom, first and second sides running between the top and the bottom, and a series of key holes formed in each of the first and second sides; and a shelf installation tool to be attached to the pair of upper and lower corner posts by which to hold the pair of upper and lower corner posts in axial alignment with one another so that the shelf can be coupled to the pair of corner posts at the interface therebetween, said shelf installation tool including an upper corner post surrounding section that surrounds the bottom of the upper one of said pair of upper and lower corner posts and a lower corner post surrounding section that surrounds the top of the lower one of said pair of upper and lower corner posts, wherein said upper and lower corner post surrounding sections are located one above the other and separated from one another by a space therebetween, said shelf installation tool also including a first corner post coupling leg having a top and a bottom, said upper corner post surrounding section extending from the top of said first corner post coupling leg, and said lower corner post surrounding section being spaced below said upper corner post surrounding section and extending from the bottom of said first corner post coupling leg, and a second corner post coupling leg having a to and a bottom, said first corner post coupling leg lying adjacent and attached to said second corner post coupling leu by a leg hinge, such that said first and second corner post coupling les are rotatable relative to one another at said leg hinge when the upper and lower corner post surrounding sections surround the bottom of the upper one of said pair of upper and lower corner posts and the too of the lower one of said pair of upper and lower corner posts to create a splice by which said pair of upper and lower corner posts are held one above the other.

2. The combination recited in claim 1, wherein said first and second corner post coupling legs are rotatable relative to one another at said leg hinge so as to lie flush against respective ones of the first and second sides of each of the upper and lower corner posts of said pair of corner posts being held one above the other.

3. The combination recited in claim 2, wherein said first corner post coupling leg has an upper tool positioning base projecting from the top thereof and a lower tool positioning base projecting from the bottom thereof, said upper tool positioning base being received by one of the series of key holes formed in the first side of the upper one of said corner posts, and said lower tool positioning base being received by one of the series of key holes formed in the first side of the lower one of said corner posts to prevent said shelf installation tool from sliding relative to the upper and lower ones of said corner posts after said first and second corner post coupling legs rotate relative to one another and lie flush against the respective first and second sides of each of the pair of upper and lower corner posts.

4. The combination recited in claim 3, wherein said second corner post coupling leg has an upper locking tab projecting from the top thereof and a lower locking tab projecting from the bottom thereof, said upper locking tab lying over and against the second one from the bottom of the series of key holes formed in the second side of the upper one of said pair of corner posts, and said lower locking tab lying over and against the second one from the top of the series of key holes formed in the second side of the lower one of said pair of corner posts after said first and second corner post coupling legs rotate relative to one another at said leg hinge and lie flush against the respective first and second sides of each of said pair of upper and lower corner posts.

5. The combination recited in claim 4, wherein each of said upper and lower corner post surrounding sections has an end flap connected thereto and a locking slot formed in said end flap, the upper locking tab projecting from the top of said second corner post coupling leg being received by the locking slot of the end flap connected to said upper corner post surrounding section, and the lower locking tab projecting from the bottom of said second corner post coupling leg being received by the locking slot of the end flap connected to said lower corner post surrounding section after said first and second corner post coupling legs rotate relative to one another at said leg hinge and lie flush against the respective first and second sides of each of said pair of upper and lower corner posts, whereby to hold said shelf installation tool in surrounding engagement with the top of the lower one of said pair of corner posts and the bottom of the upper one of said pair of corner posts.

6. The combination recited in claim 5, wherein each of said upper and lower corner post surrounding sections includes at least one corner post surrounding arm having first and opposite sides, the at least one corner post surrounding arm of said upper corner post surrounding section being connected at the first side thereof by a first arm hinge to the top of the first corner post coupling leg and connected at the opposite side thereof by a second arm hinge to the end flap of said upper corner post surrounding section, and the at least one corner post surrounding arm of said lower corner post surrounding section being connected at the first side thereof by a third arm hinge to the bottom of the first corner post coupling leg and connected at the opposite side thereof by a fourth arm hinge to the end flap of said lower corner post surrounding section.

7. The combination recited in claim 6, wherein each of the at least one corner post surrounding arms of said upper and lower corner post surrounding sections has a tool pull-off tab depending therefrom and responsive to a pulling force applied thereto to pull the locking slot of the end flap of each of said upper and lower corner post surrounding sections out of its receipt of the upper and lower locking tabs projecting from the top and the bottom of the second corner post coupling leg.

8. A combination comprising:

a pair of upper and lower corner posts to which a shelf from a shelving system is to be connected, each of the pair of corner posts having a top and a bottom, first and second sides running between the top and the bottom, and a series of key holes formed in each of the first and second sides, and a shelf installation tool to be attached to the pair of upper and lower corner posts by which to hold the corner posts in axial alignment with one another so that the shelf can be coupled to the pair of corner posts at the interface therebetween, said shelf installation tool including a plurality of corner post surrounding members comprising at least one vertically extending corner post coupling leg having a top and a bottom, at least one upper corner post surrounding arm hingedly connected to the top of said corner post coupling leg and extending horizontally from said top, and at least one lower corner post surrounding arm hingedly connected to the bottom of said corner post coupling leg and extending horizontally from said bottom so as to lie below and be separated from said upper corner post surrounding arm by a space therebetween, said at least one corner post coupling leg lying flush against one of the first or second sides of each of the pair of upper and lower corner posts and said at least one upper corner post surrounding arm and said at least one lower corner post surrounding arm being rotatable relative to said at least one corner post coupling leg so as to surround the bottom of the upper one of said pair of corner posts and the top and the lower one of the pair of corner posts, whereby to create a splice for holding said pair of corner posts one above the other.

9. The combination recited in claim 1, wherein each of the first and second corner post coupling legs of said shelf installation tool has a pair of key holes formed therein and adapted to receive respective pairs of coupling heads that project from the shelving system through a corresponding pair of key holes from the series of key holes that are formed in each of the first and second sides of each of the pair of upper and lower corner posts.

* * * * *